United States Patent [19]

Evans

[11] Patent Number: 4,893,357

[45] Date of Patent: Jan. 16, 1990

[54] REVERSIBLE HAND WARMING MUFF

[76] Inventor: Keith O. Evans, 12296 W. Bay Sh. Dr., Traverse City, Mich. 49684

[21] Appl. No.: 158,553

[22] Filed: Feb. 22, 1988

[51] Int. Cl.[4] ..... A41D 13/08; A41D 19/00

[52] U.S. Cl. ..... 2/208; D2/611

[58] Field of Search ..... 2/208, 158; D2/611

[56] References Cited

U.S. PATENT DOCUMENTS

| | | | |
|---|---|---|---|
| 272,380 | 2/1883 | Ganss | 2/66 |
| 342,049 | 5/1886 | Spitzer | 2/66 |
| 784,857 | 3/1905 | Grushoff | 2/66 |
| 1,066,779 | 7/1913 | Anderson | 2/66 |
| 2,835,896 | 5/1958 | Giese | 2/66 |
| 4,408,355 | 10/1983 | Brock | 2/66 |
| 4,495,659 | 1/1985 | Madnick et al. | 2/66 |

FOREIGN PATENT DOCUMENTS

| | | | |
|---|---|---|---|
| 337789 | 6/1921 | Fed. Rep. of Germany | 2/66 |

*Primary Examiner*—Steven N. Meyers
*Assistant Examiner*—Jeanette E. Chapman

[57] ABSTRACT

A combination reversible hand warming muff with a belt attached to the same. The muff is composed of a cylindrical tube having inner and outer layers or surfaces and an insulative layer inbetween the above two. The combination includes a belt attached to the muff by channels formed on the inner and outer surfaces of the muff and the belt is inserted therethrough. The muff is made reversible by turning the same inside out. The inside layer is composed of a different color and/or material than the outer layer.

6 Claims, 1 Drawing Sheet

REVERSIBLE HAND WARMING MUFF

SUMMARY OF INVENTION

The reversible hand warming muff is secured around the waist of the user by a single reversible, adjustable belt and is uniquely different from all other hand warming devices. The reversibility of both the hand warming muff and the belt, provides the user with double value. Essentially, two for the price of one. By having both the muff and the belt reversible, it guarantees the user sameness of color and material being seen. This may be especially appealing to hunters who want camouflage or blaze orange to be seen. It would also appeal to users who want color coodination when using the muff at sporting events, such as football games. Logos of two different teams or schools, such as a local high school and a favorite university or professional team could be used on the muff, with matching colors on the belt.

By using adhesive strips on the belt ends it allows for easy reversibility and sizing. The belt slides through the belt channel, located on the outside of the muff. The adhesive strips sewn on the inside of the belt channel attach to adhesive strips sewn to both sides of the belt, approximately in the middle of the belt. When the adhesive strips on the belt are attached to those on the muff it holds the muff firmly to the belt. The user then wraps the belt around their waist and attaches together the adhesive strips sewn on both ends of the belt, thereby holding the muff snuggly to the body of the user.

This invention is also unique because the belt channel becomes the pocket when the muff is turned inside out and vice versa. Adhesives sewn along the outer edges of the belt-channel-pocket are used to close the pocket ends to secure any items carried within.

The user inserts one or both hands into the muff through cuffs sewn into each end. The cuffs provide the user quick entry and withdrawal, yet contain the heat within by fitting snuggly around the wrists. Removing one's hands quickly, can be important to prevent falls if tripped, or if the activity engaged in requires it.

The muff may be constructed of insulated, quilted, and/or waterproof materials, as well as wools and furs, both natural and synthetic. The belt would be made of some type of strapping material covered with the matching materials of the muff to which it would be attached.

DETAILED DESCRIPTION

Figure 1:
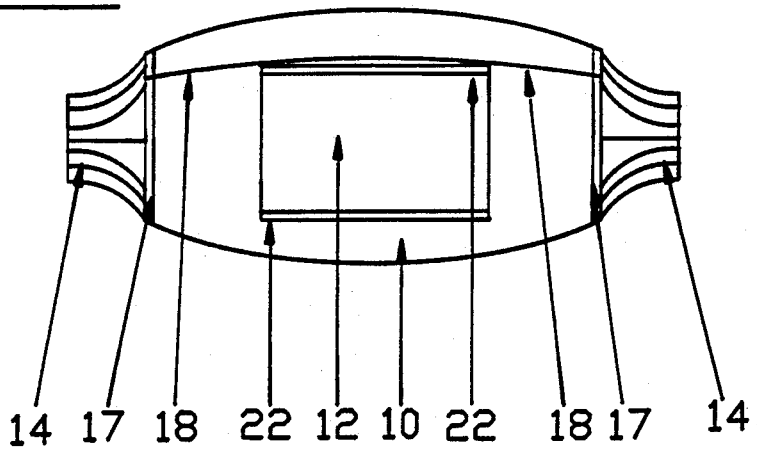
FIG. 1 is the reversible muff viewed from the rear, showing the belt channel in the middle of the muff, without the belt attached.

In referring to FIG. 1, there is shown a reversible hand warming muff 10. The same is composed of a cylindrical tube secured in the disclosed form at seam 18, having two open distal ends, inner and outer layers or surfaces, and an insulative layer disposed between the outer and inner layers. Cylindrical cuffs, 14, are secured to each distal end of the muff along seam 17. A rectangular, longitudinal strip is sewn at seam 22, intermediate the muff's distal ends on the inner and outer muff surfaces, in the lengthwise direction to the tube. This strip provides a belt channel, 12, for which a reversible muff belt, 11, in FIG. 4, can be inserted. The channel can alternatively function as a pocket by placing a first hook and pile fastener tape, 24, VELCRO TM on both the inner open edges of the belt channel; a second VELCRO TM tape is placed, on the muff, directly below the first strip. By pressing the strips on the channel and muff together, a pocket is formed and/or closed.

The materials used to make the reversible hand warming muff 10 will vary. In most cases it will be of some type of insulated and/or waterproof materials, which will compose the basic structure of the muff 10.

Figure 3:
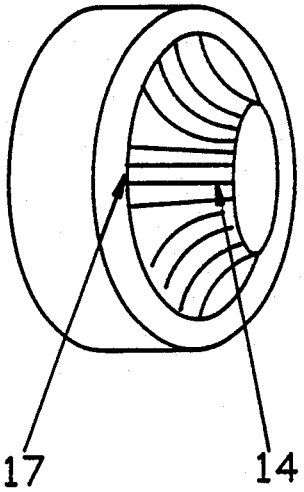
FIG. 3 is a side view showing the cuff.

The cuffs 14, in FIG. 3 will be make from natural and synthetic materials and blends thereof.

The reversible muff belt is composed of a long strip of material that is able to encircle a wearer's waist. The same has two distal ends and inner and outer surfaces. The material on the outside 20 of the belt, 11, will match the material on the outside of the muff 10. The material on the inside of the belt 11 will match that on the inside of the muff 10. When the muff 10 is turned inside out the belt 11 will be reversed so that the color materials match that on the outside of the muff 10.

Figure 2:
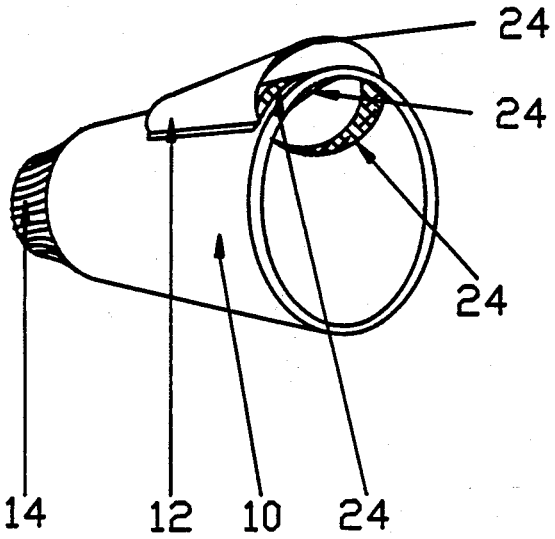
FIG. 2 is a sectional view of the muff with one cuff end removed. The end of the belt channel and adhesive strips sewn on its edges can be seen on the outside of the muff. On the inside one can see the end of the pocket with the adhesive strips sewn on the end.
Figure 4:
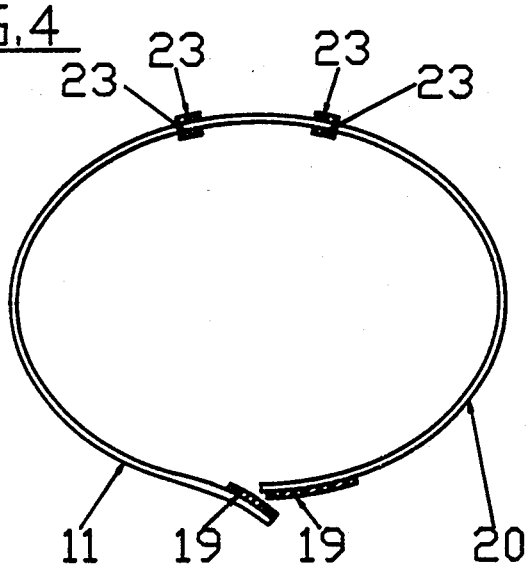
FIG. 4 is a top view of the reversible belt showing the adhesive strips sewn on both sides of the belt's middle which attach to the adhesive strips sewn inside the belt channel on the muff. Adhesive strips can be seen sewn on both ends of the belt for attachment together to secure the belt around the user.

Adhesive strips 23 on the belt FIG. 4, will attach to the adhesive strips 24, FIG. 2 on the inside of the belt channel to hold the muff 10 firmly to the belt 11.

The adhesive strips 19, on the distal ends of the belt shown in FIG. 4, make the belt 11 readily adjustable when the belt 11 is wrapped around the user and the adhesive strips 19 are pressed together.

As seen in FIG. 2, the adhesive strips 24 sewn on the edges of the belt channel 12-pocket, when pressed together closes the belt channel 12 to make a pocket when on the inside of the muff 10. This will allow the user to carry items inside the pocket.

Figure 5:
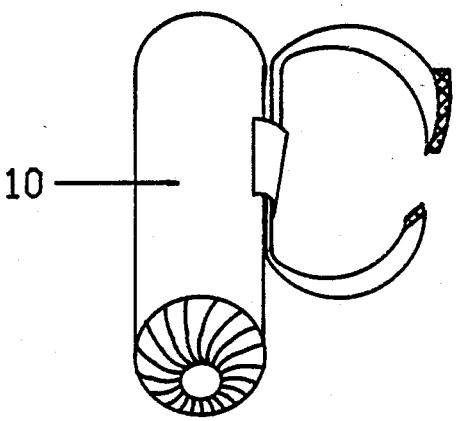
FIG. 5 is a top and partial side view of the reversible muff with the reversible belt attached.

FIG. 5 illustrates the reversible hand warming muff 10 with the reversible, any sized belt 11 attached.

While it is understood that previous hand devices have been patented, none have been invented which are reversible. This application is therefore seeking the appropriate patent recognition of the unique and useful improvements thereof.

What is claimed is:

1. A combination reversible hand warming muff with a belt comprising:

(a) A cylindrical tube having two distal open ends and inner and outer surfaces or layers:

(b) A cylindrical cuffs sewn to each of said open ends of said tube:

(c) A rectangular longitudinal strip, each sewn intermediate to the said open ends, along the inner and outer surfaces, in a lengthwise direction on the said tube, to provide a double open ended belt channel having inner open edges, thru which a reversible muff belt can pass.

2. The combination of claim 1 wherein said belt channel can alternatively function as a pocket by placing:

a first hook and pile fastener tape, on each inner open edge of said channels:

a second, hook and pile fastener tape is placed below each of said first tapes on the said tube: and when the said tapes on the muff and the channels are pressed together the pocket in formed.

3. The combination of claim 2, wherein said belt comprises:

a. a long strip of material able to encircle a wearer's waist having two-distal ends and inner and outer surfaces or layers:

b. hook and loop pile fasteners strips VELCRO TM, intermediate the two distal ends secured to both of the said inner and outer surfaces to engage with and secure to the said first and second tapes on the inner open edges of the belt channel.

4. The combination of claim 1 further comprising, the outer layer being of a different color and type of material than the inner layer and an insulative layer is disposed between the two.

5. The combination of claim 4 wherein the material of the inner and outer layers of the belt matches the material on the inner and outer layers of the muff, respectively.

6. The combination of claim 1 or 4 includes the muff being reversible upon itself by inserting a hand of one's wearer into the tube and grasping the opposite end and pulling the same through the tube.

* * * * *